United States Patent [19]

Narozny

[11] 4,067,637

[45] Jan. 10, 1978

[54] ELECTRICAL CONNECTOR

[75] Inventor: Ronald S. Narozny, Panorama City, Calif.

[73] Assignee: Thomas & Betts Corporation, Elizabeth, N.J.

[21] Appl. No.: 749,096

[22] Filed: Dec. 9, 1976

[51] Int. Cl.[2] ..... H01R 13/46

[52] U.S. Cl. ..... 339/198 G; 339/208; 339/210 M

[58] Field of Search ..... 339/176 M, 176 MP, 198 G, 339/198 P, 206 R, 206 P, 207 R, 207 S, 208, 210 R, 210 M

[56] References Cited

U.S. PATENT DOCUMENTS

| | | | |
|---|---|---|---|
| 3,233,210 | 2/1966 | Knowles | 339/208 |
| 3,325,769 | 6/1967 | Travis | 339/31 M |
| 3,395,377 | 7/1968 | Straus | 339/176 MP |
| 3,518,610 | 6/1970 | Goodman | 339/176 MP |
| 3,525,972 | 8/1970 | Asick | 339/206 R |

FOREIGN PATENT DOCUMENTS

| | | | |
|---|---|---|---|
| 2,528,790 | 1/1976 | Germany | 339/176 MP |

*Primary Examiner*—Roy Lake
*Assistant Examiner*—Mark S. Bicks
*Attorney, Agent, or Firm*—David Teschner; Jesse Woldman

[57] ABSTRACT

A multiposition modular connector assembly includes lower and upper halves each comprising a series of frangibly interconnected connector elements, each upper element being individually engaged to a lower element by latch means to provide a composite structure preselectively partable into segments of a predetermined number of positions.

10 Claims, 14 Drawing Figures

ELECTRICAL CONNECTOR

BACKGROUND OF THE INVENTION

1. Field of the Invention

The invention is directed to the field of multiposition electrical connectors.

2. Description of the Prior Art

Modular connectors are known in the prior art as exemplified, for example in U.S. Pat. No. 2,396,725 issued to G. C. Thomas, Jr. on Mar. 19, 1946; and assigned to the assignee of the instant invention, U.S. Pat. No. 3,325,769 issued to L. R. Travis on June 13, 1967; and U.S. Pat. No. 3,537,061 issued to H. Haag et al. on Oct. 27, 1970. Haag discloses an apparatus in which discrete elements may be joined to one another to build up a composite structure whereas Thomas and Travis disclose an apparatus in which a continuous strip of previously interconnected elements may be divided into smaller segments containing a predetermined number of positions. However, in each case, the connector elements have fully enclosed chambers which are limited to the acceptance therein of discrete individual elements. Such devices are therefor not adaptable to placement over the edge of a printed circuit board or like element which requires an elongate contiguous opening in the connector. Furthermore, there is no provision in such prior art devices for opening the connector to provide access to the interior thereof for selective insertion or removal of one or more electrical contact elements or parts.

SUMMARY OF THE INVENTION

The invention overcomes the limitations and difficulties noted above with respect to such prior art devices by providing a modular electrical connector having upper and lower halves comprised of frangibly interconnected separable elements the lower halves of which are releasably interlocked to a corresponding upper half to permit dividing the basic connector assembly into smaller segments having a predetermined number of positions each of which includes separable upper and lower elements. The latching means interlocking the upper and lower halves comprises in a preferred embodiment, a series of deflectable struts extending downwardly from the upper or cover portion of the connector at selected intervals corresponding to each position of the connector and arranged to interlock with mating protrusions located between connector elements of the lower portion of the connector so that each upper connector element is latchingly engaged to each lower connector element. Each of the lower connector elements may be provided with foreshortened sidewalls bordering an electrical contact to provide a series of communicating openings approximating a contiguous slot extending along one longitudinal edge of the connector. Other configurations may include socket type openings or extending male contacts for mating engagement with a conforming receiver. It is thus an object of this invention to provide an improved modular connector.

It is another object of this invention to provide a selectively severable modular electrical connector.

It is a further object of this invention to provide a modular electrical connector adapted to engage the edge of a panel or other like electrical device.

It is still another object of this invention to provide a modular electrical connector having upper and lower halves which may be selectively releasably interlocked at a plurality of discrete locations.

It is yet a further object of this invention to provide a selectively severable modular electrical connector which may be adapted to interconnect planar electrical elements of varying widths.

It is still a further object of this invention to provide a selectively severable modular electrical connector having a basic configuration which may be readily converted to a male, female, or card edge connector.

It is yet another object of this invention to provide a modular electrical connector having separable upper and lower halves each of which may comprise partable connector elements having individual electrical contacts therein.

Other objects and features of the invention will be pointed out in the following description and claims and illustrated in the accompanying drawings which disclose, by way of example, the principle of the invention and the best mode contemplated for carrying it out.

BRIEF DESCRIPTION OF THE DRAWINGS

In the Drawings.

Similar elements are given similar reference characters in each of the respective drawings.

DESCRIPTION OF THE PREFERRED EMBODIMENT

Figure 1:
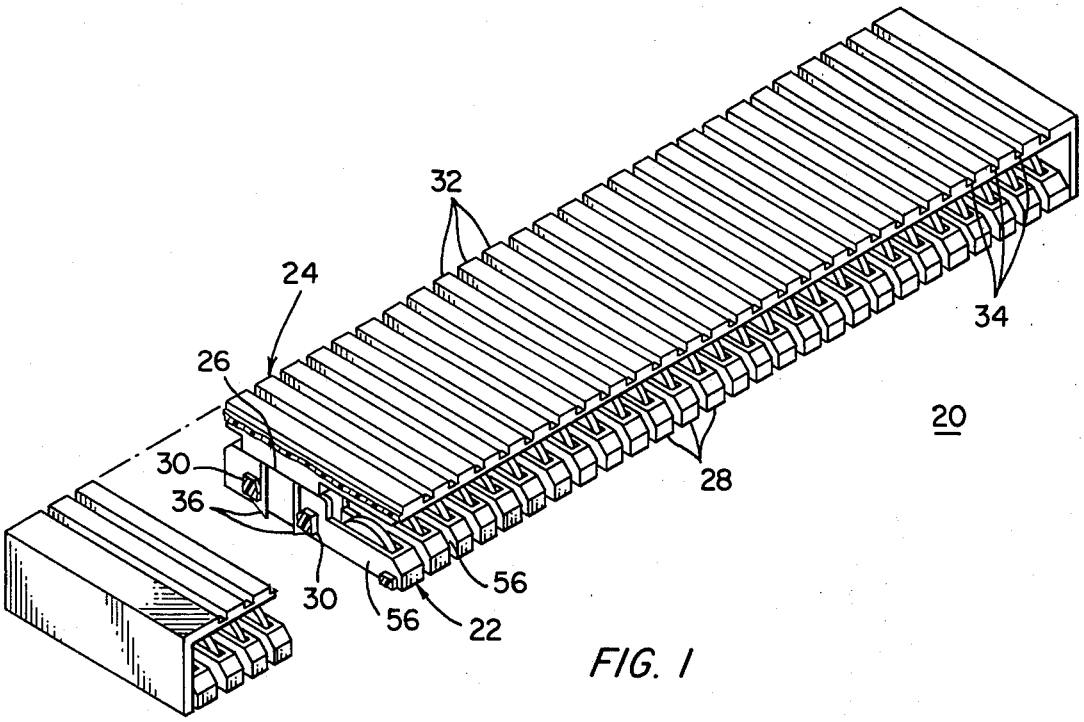
FIG. 1 is a fragmentary perspective view, partly in section, of an electrical connector constructed in accordance with the concepts of the invention.
Figure 2:
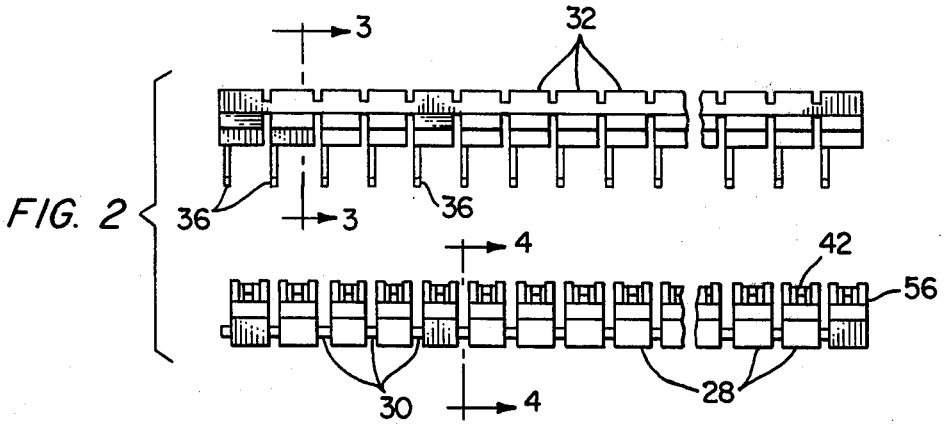
FIG. 2 is a fragmentary front elevational view showing the device of FIG. 1 in a disassembled state.
Figure 3:
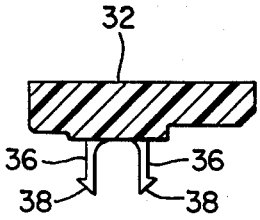
FIG. 3 is a side elevational view, in section, taken along the line 3—3 of FIG. 2.
Figure 4:
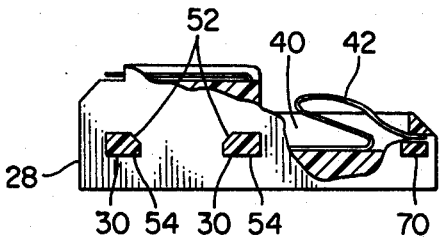
FIG. 4 is a fragmentary side elevational view, partly in section and partly cut away, taken along the line 4—4 of FIG. 2.
Figure 5:
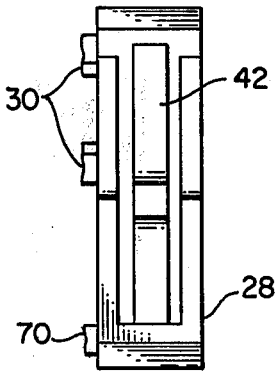
FIG. 5 is a fragmentary top plan view of a single connector element of the device of FIG. 1.
Figure 6:
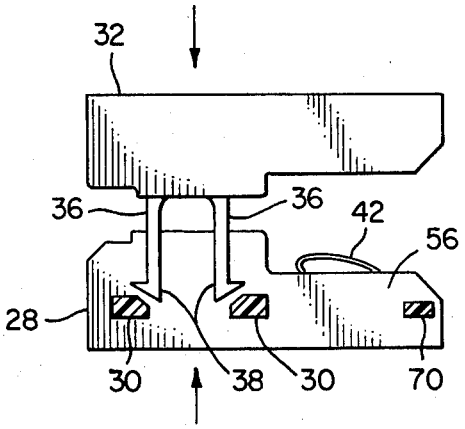
FIG. 6 is a side elevational view showing the latching mechanism of the device of FIG. 1 in a preparatory state.
Figure 7:
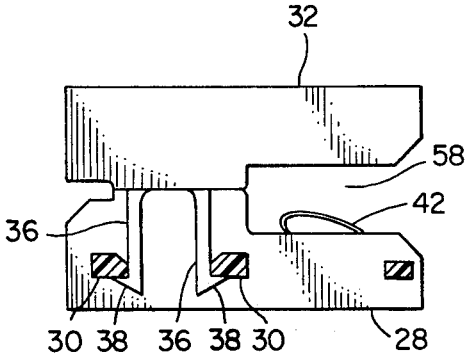
FIG. 7 is a side elevational view, similar to FIG. 6, showing the latching mechanism in a latched state.
Figure 8:
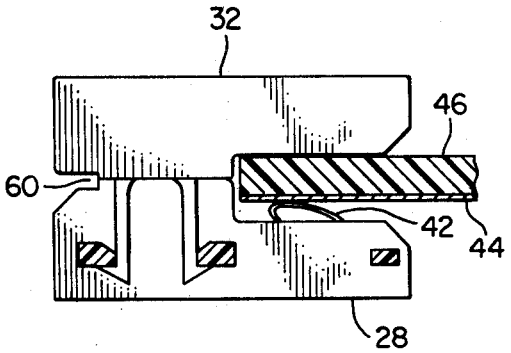
FIG. 8 is a side elevational view showing the edge of a printed circuit board engaged by the connector of FIG. 1.

Turning now to FIGS. 1 through 8 there is shown an electrical connector 20 (FIG. 1) constructed in accordance with the concepts of the invention. The connector 20 comprises a base member 22, a cover member 24 overlying the base member 22 and releasably interlocked thereto by a series of latch means 26. The base member 22 comprises a series of contact support members 28 formed in a strip and interconnected to one another by frangible portions shown as discrete protrusions 30 (FIG. 2) selectively located along the side of each support member 28. The protrusions 30 serve a dual function as will be described in greater detail hereafter. The cover member 24 comprises a series of elements 32 formed in a strip and interconnected to one another by frangible portions shown as thin elongate webs 34 of reduced cross section coincident with the protrusions 30 for parting the elements 32 at preselected locations commensurate with the parting of the support members 28. The latch means 26 is shown as comprising a pair of spaced deflectable legs or struts 36 depending from each element 32, each of the struts 36 having a hooked end portion 38 (FIG. 3) which engages the undersurface of a corresponding protrusion 30 as the cover member 24 and the base member 22 are urged together in the manner shown in FIGS. 6 and 7. To unlatch one or more of the elements 32 from a corresponding support member 28, the appropriate pair of struts 36 are forced together at each location to release their hooked end portions 38 from engagement with the corresponding protrusions 30. As further illustrated, each of the contact support members 28 includes a contact receiving recess 40 (FIG. 4) in which is located a contact element 42 shown in FIG. 4 as formed in a loop to provide resilient electrical engagement with the conductive portion 44 of a further external member such as 46 (FIG. 8). Although only the support members 28 are shown as having contact elements 42, an arrangement such as that shown in FIG. 14 may be readily and conveniently provided wherein a cover member 48 similar to member 32 is illustrated as containing a further contact element 50 similar to element 42. In this embodiment electrical engagement may be made to either or both surfaces of a part such as 46 (FIG. 8) which may comprise a conductive surface such as 44 on both surfaces thereof. The protrusions 30 which function as frangible portions interconnecting the support members 28 one to another also serve as engaging elements for the deflectable struts 36. As is more clearly shown in FIG. 4, each protrusion 30 comprises a tapered edge 52 for camming a respective strut 36 inwardly during the latching operation, and a locking surface 54 forming the underside of each protrusion 30 for engaging the hooked end portion 38 of a respective strut 36 to maintain the support member 28 and a corresponding cover member 32 in locked relationship. In the embodiment illustrated in FIG. 1 each of the members 28 is provided with foreshortened sidewalls 56 to expose a portion of the contact element 42 and to provide a contiguous elongate opening or slot 58 (FIG. 7) along one edge of the connector 20. The slot 58 may thus be utilized to receive the edge of a flat elongate part such as 46 which may comprise, for example, the edge of a printed circuit board or like element. The contact element 42 may be suitably formed so as to extend rearwardly within the support member 28 adjacent to an opening 60 (FIG. 8) into which may be inserted a further external member (not shown) for electrical connection to selective elements of the part 46. The contact support members 28 and cover member elements 32 are initially formed in strips comprising a given number of positions in accordance, for example, with the maximum number of positions which may be required in a particular application or for a particular use. If less positions are required, each of the strips may be parted or fractured at a respective frangible portion such as 30, 34, whereby both the upper and lower parts of the connector 20 contain the same number of positions. This may be accomplished either prior or subsequent to the latching operation. The user thus has available a basic assembly which may be readily divided into smaller assemblies of predetermined size and capacity, each of the smaller assemblies being comprised of individually latched connector elements 28 and 32. For example, the connector 20 may originally comprise sixty positions, as manufactured. It may then be desired to provide both a twenty position and forty position connector. In such case the user simply counts off the number of positions desired and fractures the upper and lower strips at the desired locations — which in this example, will result in two smaller assemblies containing the desired number of positions. Each assembly thus becomes an integral connector complete with upper and lower connector elements individually latched to one another in the same manner as the original connector 20. Furthermore, each smaller assembly may be opened and reassembled repeatedly merely by suitably manipulating the struts 36. It will of course be apparent that closure or latching of the elements 32 to their associated support members 28 may be accomplished in various sequences, that is, either simultaneously or progressively. For simultaneous latching, the strip containing the elements 32 is placed directly adjacent the strip containing the members 28. A uniform force of sufficient magnitude is then applied to the outer surface of both strips to cause each of the struts 36 to engage with its respective protrusion 30. An equally adequate method which requires somewhat less force involves placing the strips together as before, but, rather than applying a uniform force to the strips, applying a force at one end of the assembly and progressively shifting the application line of the force towards the other end so that each pair of parts 28 and 32 is latched together individually in zipper-like fashion. Of course any combination of the above methods may be employed to effect the same result.

Figure 9:
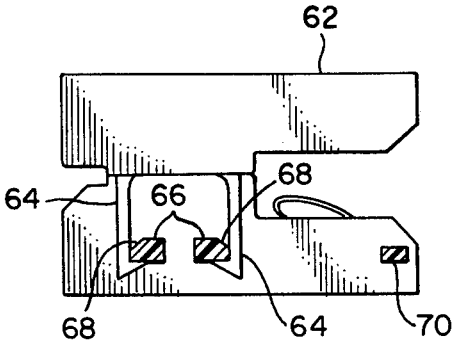
FIG. 9 is a side elevational view showing a further embodiment of a latching means for an electrical connector constructed in accordance with the concepts of the invention.

In FIG. 9 there is shown a further embodiment of the latch means of the invention wherein a cover member element 62 comprises struts 64 similar to struts 36 but spaced apart from one another so as to straddle engaging elements 66 on the outboard side thereof, elements 66 being essentially similar to elements 36 but having their tapered camming edges 68 facing away from one another. It will be appreciated that the unlatching operation associated with the embodiment of FIG. 9 will be the reverse of that described with respect to the embodiment shown in FIGS. 1 through 8 in that the struts 64 are required to be moved apart rather than together to effect their disengagement from the engaging means 66. It should also be appreciated that in the embodiment shown in FIG. 9 the two elements 66 may be combined to provide a single protrusion (not shown) having tapered edges corresponding to the edges 68. The resiliency and deflectability of the struts 36 and 64 may of course be readily controlled by varying their cross sectional dimensions which will also control the force required for the latching and releasing operation. It should be further understood that the relative positions of the struts 36 and 64 with respect to the respective engaging means 30 and 66 may be reversed, i.e., the struts may be located on the contact support members 28 and the engaging means located on the corresponding cover member elements 32 or 62 in accordance with the spirit of the invention and within the concepts herein disclosed. It will of course be appreciated that the engaging means 66 may also serve as frangible portions in the same manner as elements 30 described above. However, in either case, there may be provided additional elements such as 70 (FIG. 4) on each contact support member 28 which may serve as an additional frangible portion where necessary or desirable, or may be alternatively employed as the sole interconnecting frangible member between adjacent members 28 wherein the engaging means 30 will then function solely in conjunction with the struts 36 to provide the latch means for the connector 20. In the latter case, the means 30 will be attached to only one sidewall between adjacent members 28.

Figure 10:
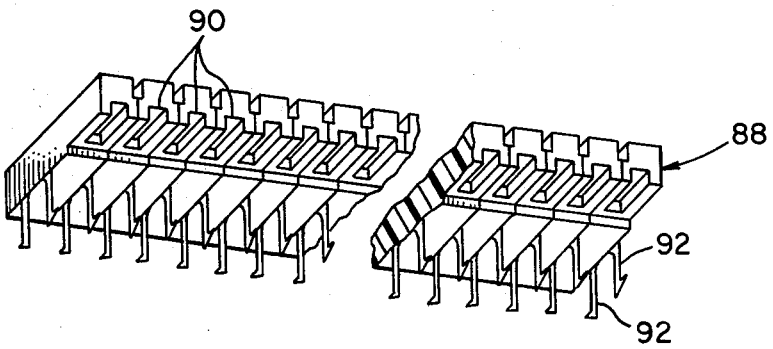
FIG. 10 is a fragmentary perspective view, partly in section, of the cover member of a further embodiment of an electrical connector constructed in accordance with the concepts of the invention.
Figure 11:
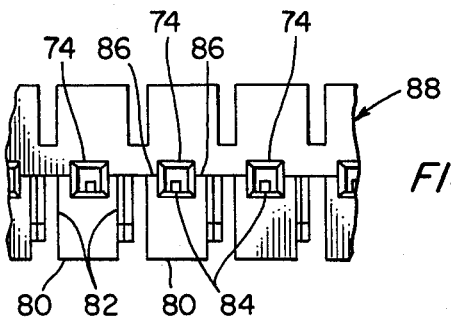
FIG. 11 is a fragmentary front elevational view showing a further embodiment of an electrical connector constructed in accordance with the concepts of the invention.
Figure 12:
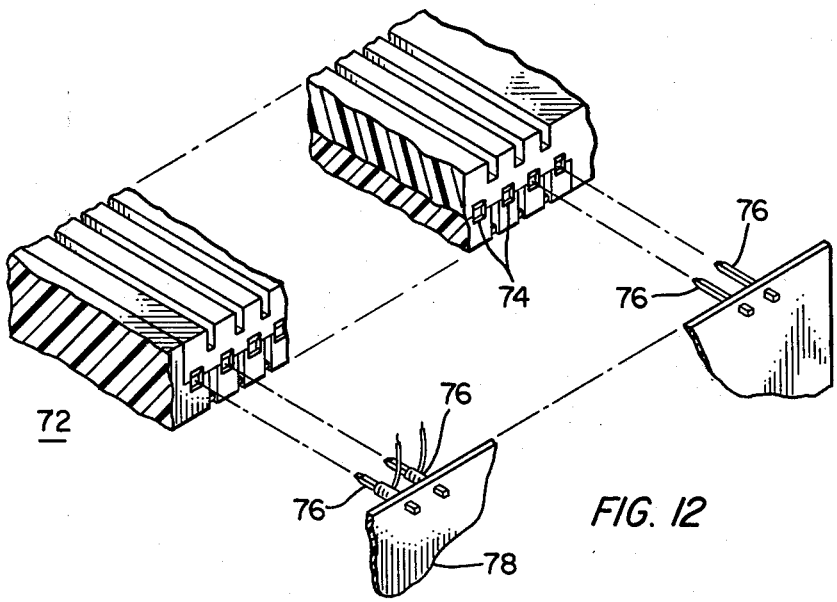
FIG. 12 is an exploded fragmentary perspective view, partly in section, showing the embodiment of FIG. 11 adapted to receive the male pins of a further electrical device.

FIGS. 10, 11, and 12 illustrate a further embodiment of an electrical connector 72 constructed in accordance with the concepts of the invention and which differs from the connector 20 in providing a series of fully enclosed discrete pin receiving openings 74 (FIG. 11) adapted to receive individual pins such as 76 (FIG. 12) which may comprise wire-wrap posts or the like attached to a circuit board 78. In this embodiment there is provided a series of frangibly interconnected contact support members 80 connected to one another in an arrangement similar to that shown in FIGS. 1 and 2 with respect to members 28. In this case, however, each member 80 is provided with fully extended sidewalls 82 flanking a contact receiving recess 84 so that the upper edges of the sidewalls 82 communicate with lower edges 86 of a cover member strip 88 having recesses 90 forming the upper half of the openings 74 while the recesses 84 define the lower half thereof. The strip 88 is otherwise similar to the strip 24 and includes pairs of struts 92 duplicative of elements 36 described heretofore.

Figure 13:
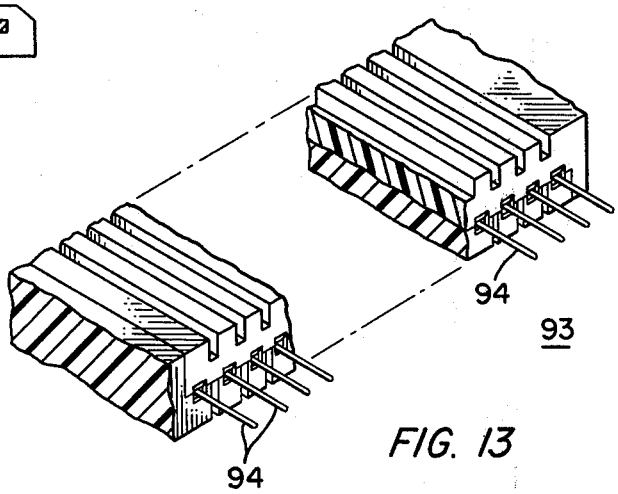
FIG. 13 is a fragmentary perspective view, partly in section, of a further embodiment of an electrical connector constructed in accordance with the concepts of the invention.

FIG. 13 shows a further embodiment of an electrical connector 93 constructed in accordance with the concepts of the invention. The connector 93, although otherwise similar to connector 72, is provided with pin-like extensions 94 adapted to mate with suitably formed socket elements (not shown), the connector 93 being essentially the male counterpart of the connector 72. It is also contemplated that combinations of the connectors 72 and 93 may be fabricated to provide, for example, alternating male and female positions. It should be understood that each of the embodiments shown in FIGS. 12 and 13 also include the frangible portions and latch means described heretofore with respect to the embodiment illustrated in FIG. 1.

Figure 14:
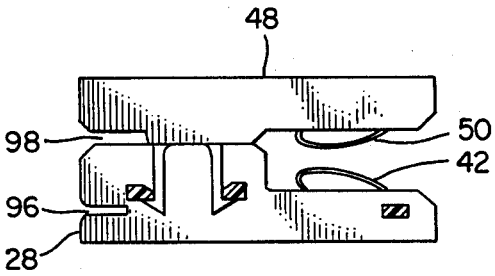
FIG. 14 is a side elevational view, of yet another embodiment of an electrical connector constructed in accordance with the concepts of the invention.

As further illustrated in FIG. 14, the embodiment shown therein may comprise two rearwardly facing openings 96 and 98, each being associated with a corresponding contact element 42 and 50, respectively to provide discrete connections to an external member (not shown) inserted within either of the openings 96 or 98.

It will also be appreciated that the strips 22 and 24 may be conveniently constructed from any one of a number of suitable dielectric materials having good electrically insulating properties, and may be individually fabricated in continuous lengths which may be readily separated into the desired segment sizes by the user.

The embodiments of the invention in which an exclusive property or privilege is claimed are defined as follows:

1. In an electrical connector of the type having a base member, a cover member, and contact elements contained within said base member, the improvement comprising: said base member and said cover member each comprising a series of connector elements interconnected to one another by frangible portions to facilitate parting said base member and said cover member at preselected locations, said connector further comprising latch means at each of said preselected locations for releasably interlocking each of said connector elements of said cover member to a corresponding one of said connector elements of said base member, said frangible portions interconnecting said connector elements of said base member comprising discrete protrusions located intermediate each pair of said connector elements, said latch means comprising deflectable elements each having a hooked end portion arranged to matingly interlock with a corresponding one of said discrete protrusions, said deflectable elements comprising elongate members extending from associated ones of said connector elements of said cover member.

2. The improvement as defined in claim 1 wherein each protrusion comprises a camming surface cooperable with one of said hooked end portions for selectively deflecting one of said deflectable elements.

3. The improvement as defined in claim 1 wherein each protrusion comprises a locking surface for engaging one of said hooked end portions of one of said deflectable elements.

4. An electrical connector comprising, in combination: a first strip of contact support members each having a contact receiving recess and arranged in juxtaposed relationship and interconnected to one another by first frangible portions therebetween to permit said first strip to be parted at preselected locations; a second strip of cover members arranged in juxtaposed relationship overlying said first strip, one of said cover members for each of said support members, said cover members being interconnected to one another by second frangible portions aligned with said first frangible portions to permit said first strip and said second strip to be parted along common junctures; mating latch means on each of said support members and said cover members releasably interlocking each of said cover members to a corresponding one of said support members; and a plurality of contact elements each being disposed in a respective one of said contact receiving recesses, there being an opening between each of said support members and a corresponding one of said cover members for receiving a further element in engagement with said contact element, said first frangible portions comprising discrete protrusions, said latch means comprising, in combination, deflectable elements extending from each cover member, and engaging elements on each contact support member for engagement with said deflectable elements, said engaging elements comprising said discrete protrusions.

5. An electrical connector as defined in claim 1 wherein said first frangible portions are located intermediate each pair of adjacent contact support members.

6. An electrical connector as defined in claim 4 wherein said second frangible portions are located intermediate each pair of adjacent cover members.

7. An electrical connector as defined in claim 4 wherein each contact support member comprises foreshortened sidewalls bordering its contact receiving recess to provide a contiguous slot between adjacent contact support members.

8. An electrical connector as defined in claim 4 wherein said second frangible portions each comprise an elongage segment of reduced cross-sectional area.

9. An electrical connector as defined in claim 8 wherein each of said elongate segment overlies a corresponding first frangible portion.

10. An electrical connector comprising, in combination: a first strip of contact support members each having a contact receiving recess and arranged in juxtaposed relationship and interconnected to one another by first frangible portions therebetween to permit said first strip to be parted at preselected locations, a second strip of cover members arranged in juxtaposed relationship overlying said first strip, one of said cover members for each of said support members, said cover members being interconnected to one another by second frangible portions aligned with said first frangible portions to permit said first strip and said second strip to be parted along common junctures; mating latch means on each of said support members and said members releasably interlocking each of said cover members to a corresponding one of said support members; and a plurality of contact elements each being disposed in a respective one of said contact receiving recesses, there being an opening between each of said support members and a corresponding one of said cover members for receiving a further element in engagement with said contact element, said first frangible portions comprising discrete protrusions, said latch means comprising, in combination, deflectable elements extending from each cover member, and engaging elements on each contact support member for engagement with said deflectable elements, said engaging elements comprising said discrete protrusions, said deflectable elements comprising hooked end portions arranged to matingly interlock with said engaging elements.

* * * * *